US010519895B2

(12) United States Patent
Orimo et al.

(10) Patent No.: US 10,519,895 B2
(45) Date of Patent: Dec. 31, 2019

(54) CYLINDER HEAD AND ENGINE

(71) Applicant: MITSUBISHI HEAVY INDUSTRIES ENGINE & TURBOCHARGER, LTD., Kanagawa (JP)

(72) Inventors: Kazuhisa Orimo, Tokyo (JP); Kazuo Ogura, Tokyo (JP); Seiji Tsuruoka, Tokyo (JP); Eigo Katou, Tokyo (JP)

(73) Assignee: MITSUBISHI HEAVY INDUSTRIES ENGINE & TURBOCHARGER, LTD., Kanagawa (JP)

( * ) Notice: Subject to any disclaimer, the term of this patent is extended or adjusted under 35 U.S.C. 154(b) by 184 days.

(21) Appl. No.: 15/550,940

(22) PCT Filed: Jan. 15, 2016

(86) PCT No.: PCT/JP2016/051104
§ 371 (c)(1),
(2) Date: Aug. 14, 2017

(87) PCT Pub. No.: WO2016/132787
PCT Pub. Date: Aug. 25, 2016

(65) Prior Publication Data

US 2018/0023506 A1 Jan. 25, 2018

(30) Foreign Application Priority Data

Feb. 17, 2015 (JP) ..... 2015-028497

(51) Int. Cl.
*F02F 1/36* (2006.01)
*F02F 1/40* (2006.01)
(Continued)

(52) U.S. Cl.
CPC ..... *F02F 1/36* (2013.01); *F01P 3/02* (2013.01); *F02F 1/00* (2013.01); *F02F 1/24* (2013.01);
(Continued)

(58) Field of Classification Search
CPC ..... F02F 1/36; F02F 1/38; F02F 1/40; F02F 1/42; F02F 1/10; F02F 2001/106; F02F 1/4285; F01P 3/02; F01P 2003/024
See application file for complete search history.

(56) References Cited

U.S. PATENT DOCUMENTS

2005/0193966 A1* 9/2005 Mac Vicar ..... F01P 3/02 123/41.82 R
2009/0159041 A1 6/2009 Andou et al.

FOREIGN PATENT DOCUMENTS

EP 1 571 323 A2 9/2005
GB 724461 A 2/1955
(Continued)

OTHER PUBLICATIONS

Written Opinion of the International Searching Authority and the International Search Report (Forms PCT/ISA/237 and PCT/ISA/210), dated Apr. 19, 2016, for International Application No. PCT/JP2016/051104, along with an English translation thereof.

*Primary Examiner* — Jacob M Amick
(74) *Attorney, Agent, or Firm* — Birch, Stewart, Kolasch & Birch, LLP

(57) ABSTRACT

The cylinder head includes a plurality of port wall portions configured to form flow paths for intake and exhaust, an outer circumferential wall portion formed in an annular shape disposed at an interval on an outside of the plurality of port wall portions and having a water chamber through which cooling water flows and which is formed at least between the port wall portions and the outer circumferential wall portion, and a bottom wall portion configured to face a combustion chamber of an engine and to connect ends of the port wall portions and the outer circumferential wall portion, wherein the outer circumferential wall portion includes a padding portion of which a thickness is increased toward a side close to the port wall portions so that a distance between
(Continued)

the port wall portions and the outer circumferential wall portion is equal to or less than a predetermined distance.

7 Claims, 4 Drawing Sheets

(51) Int. Cl.

| | |
|---|---|
| ***F01P 3/02*** | (2006.01) |
| ***F02F 1/00*** | (2006.01) |
| ***F02F 1/24*** | (2006.01) |
| ***F02F 1/42*** | (2006.01) |
| ***F02F 1/38*** | (2006.01) |

(52) U.S. Cl.
CPC ..... *F02F 1/38* (2013.01); *F02F 1/40* (2013.01); *F02F 1/42* (2013.01); *F02F 1/4285* (2013.01); *F02F 2001/008* (2013.01)

(56) References Cited

FOREIGN PATENT DOCUMENTS

| | | | |
|---|---|---|---|
| JP | 9-60555 | A | 3/1997 |
| JP | 2002-266696 | A | 9/2002 |
| JP | 2004-92620 | A | 3/2004 |
| JP | 2011-157827 | A | 8/2011 |
| JP | 2013-15039 | A | 1/2013 |
| WO | WO 2007/132606 | A1 | 11/2007 |

* cited by examiner

CYLINDER HEAD AND ENGINE

TECHNICAL FIELD

The present invention relates to a cylinder head and an engine.

Priority is claimed on Japanese Patent Application No. 2015-028497 filed Feb. 17, 2015, the content of which is incorporated herein by reference.

BACKGROUND ART

In a cylinder head of a reciprocating engine, a combustion surface for defining a combustion chamber has a high temperature, and thermal stress is generated. Therefore, the stress concentrates on a portion of the cylinder head which has low rigidity, and cracking or breakage may occur.

In Patent Literature 1, there is disclosed a technique in which thermal stress and thermal distortion generated on a lower surface of the cylinder head are effectively alleviated and absorbed by forming an arc-shaped groove to follow a curvature of the combustion surface of a bottom wall portion of the cylinder head defining the combustion chamber.

In the above-described reciprocating engine, a water chamber through which cooling water flows may be formed around intake/exhaust ports of the cylinder head or the like to alleviate the thermal stress and the thermal distortion of the cylinder head.

CITATION LIST

Patent Literature

[Patent Literature 1]

Japanese Unexamined Patent Application, First Publication No. 2002-266696

SUMMARY OF INVENTION

Technical Problem

In the above-described reciprocating engine, a method of increasing a compression ratio using a supercharger is known as one of methods for achieving high efficiency. When the compression ratio is increased as described, an in-cylinder pressure is increased, and the combustion surface of the cylinder head is pressed.

Openings of the intake/exhaust ports are formed in the combustion surface of the above-described cylinder head. A circumferential edge of each opening of the intake/exhaust ports and other portions of the combustion surface have different amounts of deformation when pressed with the same force from the combustion chamber.

More specifically, the rigidity of the circumferential edge of each opening of the intake/exhaust ports is higher than that of the combustion surface having the water chamber within the vicinity thereof Due to the difference in the rigidity, the bottom wall portion has a different amount of deformation according to a location thereof when pressed from the combustion chamber.

Therefore, tensile stress acts on the bottom wall portion of the cylinder head according to the difference in the amount of deformation. That is, as the in-cylinder pressure is increased, the probability of breakage such as cracking occurring in the cylinder head is increased.

An object of the present invention is to provide a cylinder head which is capable of suppressing tensile stress acting in accordance with an increase in an in-cylinder pressure and thus reducing occurrence of breakage.

Solution to Problem

According to a first aspect of the present invention, a cylinder head includes a plurality of port wall portions configured to form flow paths for intake and exhaust, and an outer circumferential wall portion formed in an annular shape disposed at an interval on an outside of the plurality of port wall portions and having a water chamber through which cooling water flows and which is formed at least between the port wall portions and the outer circumferential wall portion. The cylinder head further includes a bottom wall portion configured to face a combustion chamber of an engine and to connect ends of the port wall portions and the outer circumferential wall portion. The outer circumferential wall portion includes a padding portion of which a thickness is increased toward a side close to the port wall portions so that a distance between the port wall portions and the outer circumferential wall portion is equal to or less than a predetermined distance.

Due to such a configuration, an inner surface of the outer circumferential wall portion can approach an outer surface of the port wall portion by the padding portion. Therefore, a length of the bottom wall portion in a direction from the port wall portion to the outer circumferential wall portion can be shortened. Accordingly, it is possible to increase rigidity of the bottom wall portion and to make the bottom wall portion hard to bend. As a result, tensile stress acting on the bottom wall portion according to an increase in an in-cylinder pressure can be suppressed, and thus occurrence of breakage can be reduced.

According a second aspect of the present invention, the padding portion in the first aspect may be formed on part of the outer circumferential wall portion on a side close to the bottom wall portion.

Due to such a configuration, while a length of the bottom wall portion in a direction from the port wall portion to the outer circumferential wall portion is shortened and the tensile stress is suppressed, a weight can also be reduced as compared with the case in which the padding portion is formed over an entire region of the outer circumferential wall portion in a lengthwise direction According a third aspect of the present invention, the padding portion in the first or second aspect may be formed so that a thickness at a portion thereof facing the port wall portion satisfies a relationship of $B/A \leq 1.8$ when a distance from a port center of the port wall portion to an outer surface of the port wall portion is defined as "A" and a distance from the port center to an inner surface of the outer circumferential wall portion opposite to the port wall portion is "B."

Due to such a configuration, it is possible to suppress an increase in weight due to an excessive increase in the thickness of the padding portion and thus to efficiently suppress the tensile stress acting on the bottom wall portion.

According a fourth aspect of the present invention, the port wall portion in any one of the first to third aspects may have a port side padding portion of which a thickness is gradually increased on a side of an outer circumferential side thereof toward a side close to the bottom wall portion.

Due to such a configuration, in particular, the rigidity of the bottom wall portion around the port wall portion on which the tensile stress is easily concentrated can be improved.

According to a fifth aspect of the present invention, the port side padding portion in the fourth aspect is formed with a concave curved surface and satisfies a relationship of $R \geq 0.6 \times (B-A)$ when a curvature radius of the curved surface is defined as "R," a distance from a port center of the port wall portion to an outer surface of the port wall portion is "A" and a distance from the port center to an inner surface of the outer circumferential wall portion is "B."

Due to such a configuration, it is possible to suppress an increase in weight due to an excessive increase in the thickness of the port side padding portion and thus to efficiently suppress the tensile stress acting on the bottom wall portion on the side close to the port wall portion.

According to a sixth aspect of the present invention, in any one of the first to fifth aspects, flow paths formed by at least part of the plurality of port wall portions may rise upward from the bottom wall portion, may then be joined and connected together and may have a rib which extends along the flow paths from a crossing portion at which the flow paths intersect in a direction away from the bottom wall portion.

Due to such a configuration, even when a plurality of flow paths are joined and connected to each other and have a disadvantageous structure in terms of rigidity, the rigidity of the bottom wall portion against the in-cylinder pressure of the cylinder can be improved by the provided rib. When the rib is provided in the flow path for exhaust, a rectification effect can also be obtained.

According to a seventh aspect of the present invention, an engine includes the cylinder head according to any one of the first to sixth aspects, and a cylinder block to which the cylinder head is fastened.

Due to such a configuration, it is possible to sufficiently increase the in-cylinder pressure and thus to achieve high efficiency. As a result, it is possible to obtain a high output without increasing a size. When an increase in the output is unnecessary, the size can be reduced.

Advantageous Effects of Invention

According to the cylinder head and the engine, it is possible to suppress the tensile stress acting on the bottom wall portion in accordance with an increase in the in-cylinder pressure and thus to reduce the occurrence of breakage.

DESCRIPTION OF EMBODIMENTS

Hereinafter, a cylinder head and an engine according to one embodiment of the present invention will be described.

Figure 1:
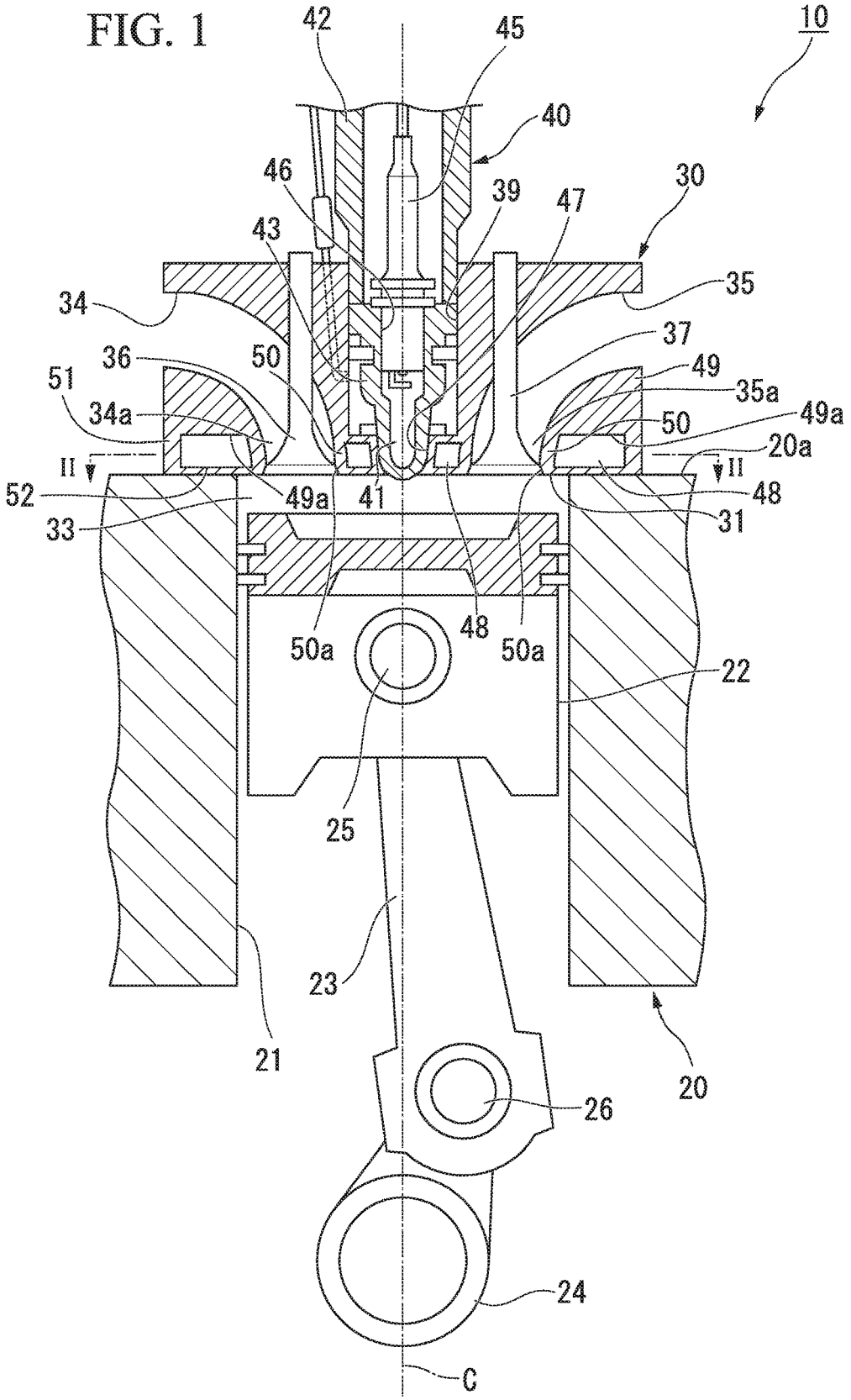
FIG. 1 is a cross-sectional view showing a configuration of an engine in a first embodiment of the present invention.

FIG. 1 is a cross-sectional view showing a configuration of an engine in a first embodiment of the present invention.

A gas engine 10 in the embodiment is an engine which is operated by burning a gaseous fuel such as city gas. The gas engine 10 in the embodiment is an auxiliary chamber type gas engine. Further, the gas engine 10 in the embodiment is a stationary gas engine which is used in power generation equipment or the like.

As shown in FIG. 1, the gas engine 10 includes at least a cylinder block 20, a cylinder head 30 and an auxiliary chamber member 40.

The cylinder block 20 has a cylindrical cylinder 21. A piston 22 is accommodated inside the cylinder 21 to linearly reciprocate along a central axis C of the cylinder 21. The piston 22 is connected to a crankshaft 24 which is rotatably supported in a crankcase (not shown) via a connecting rod 23.

The connecting rod 23 is rotatably connected to the piston 22 via a pin 25 and is rotatably connected to the crankshaft 24 via a pin 26. Accordingly, when the piston 22 moves linearly in the cylinder 21 along the central axis C, the movement of the piston 22 is transmitted to the crankshaft 24 by the connecting rod 23 and is converted into a rotational motion.

The cylinder head 30 is fastened to an end surface 20*a* of the cylinder block 20 having an opening of the cylinder 21 by a bolt or the like. Therefore, the cylinder head 30 closes the opening of the cylinder 21. A roof surface 31 having a flat shape, a hemispherical shape, or a curved surface shape orthogonal to the central axis C of the cylinder 21 is formed in a region facing the cylinder 21 on a surface of the cylinder head 30 facing the cylinder block 20 side.

A main combustion chamber 33 is defined by the cylinder block 20, the cylinder head 30 and the piston 22 described above.

An intake port 34 and an exhaust port 35 are formed in the cylinder head 30. An end 34*a* of the intake port 34 and an end 35*a* of the exhaust port 35 are opened to the roof surface 31 and face the main combustion chamber 33. The intake port 34 and the exhaust port 35 are disposed around the central axis C of the cylinder 21 and are disposed at intervals in a circumferential direction.

The intake port 34 communicates with a mixed gas supply source (not shown), and a mixed gas in which air and combustion gas are mixed is supplied from the mixed gas supply source. An intake valve 36 is provided at an end 34*a* of the intake port 34 on the side close to the main combustion chamber 33. The intake valve 36 is provided to be displaceable between a closed position and an open position by a valve drive mechanism (not shown). By displacing the intake valve 36 from the closed position to the open position, the mixed gas supplied from the mixed gas supply source flows into the main combustion chamber 33 from the intake port 34.

An end (not shown) of the exhaust port 35 on the side opposite to the main combustion chamber 33 is connected to an exhaust gas flow path (not shown). An exhaust valve 37 is provided at the end 35*a* of the exhaust port 35 on the side close to the main combustion chamber 33. By displacing the exhaust valve 37 from the close position to the open position by the valve drive mechanism (not shown), the exhaust gas of the mixed gas which is used for combustion in the main combustion chamber 33 passes through the exhaust port 35 from the main combustion chamber 33 and is then discharged to the outside through the exhaust gas flow path.

The auxiliary chamber member 40 includes an auxiliary chamber holder 42 and an auxiliary chamber base 43.

The auxiliary chamber holder 42 is fixed in an auxiliary chamber member holding hole 39 formed in the cylinder head 30. The auxiliary chamber holder 42 is disposed so that a central axis thereof overlaps an extension line of the central axis C of the cylinder 21. A gas introduction path (not shown), a plug holding hole 46 and a base holding portion 47 are formed in the auxiliary chamber holder 42. The gas introduction path introduces an auxiliary chamber gas into the auxiliary chamber 41 from the outside. The plug holding hole 46 is provided adjacent to the gas introduction path and holds an ignition plug 45. The auxiliary chamber gas in the auxiliary chamber 41 is ignited by the ignition plug 45, and a flame is generated. Here, the flame generated in the auxiliary chamber 41 flows into the main combustion chamber 33 via a hole (not shown) in the auxiliary chamber base 43. The mixed gas in the main combustion chamber 33 is ignited by the flame flowing into the main combustion chamber 33, and stable combustion is performed in the main combustion chamber 33.

Figure 2:
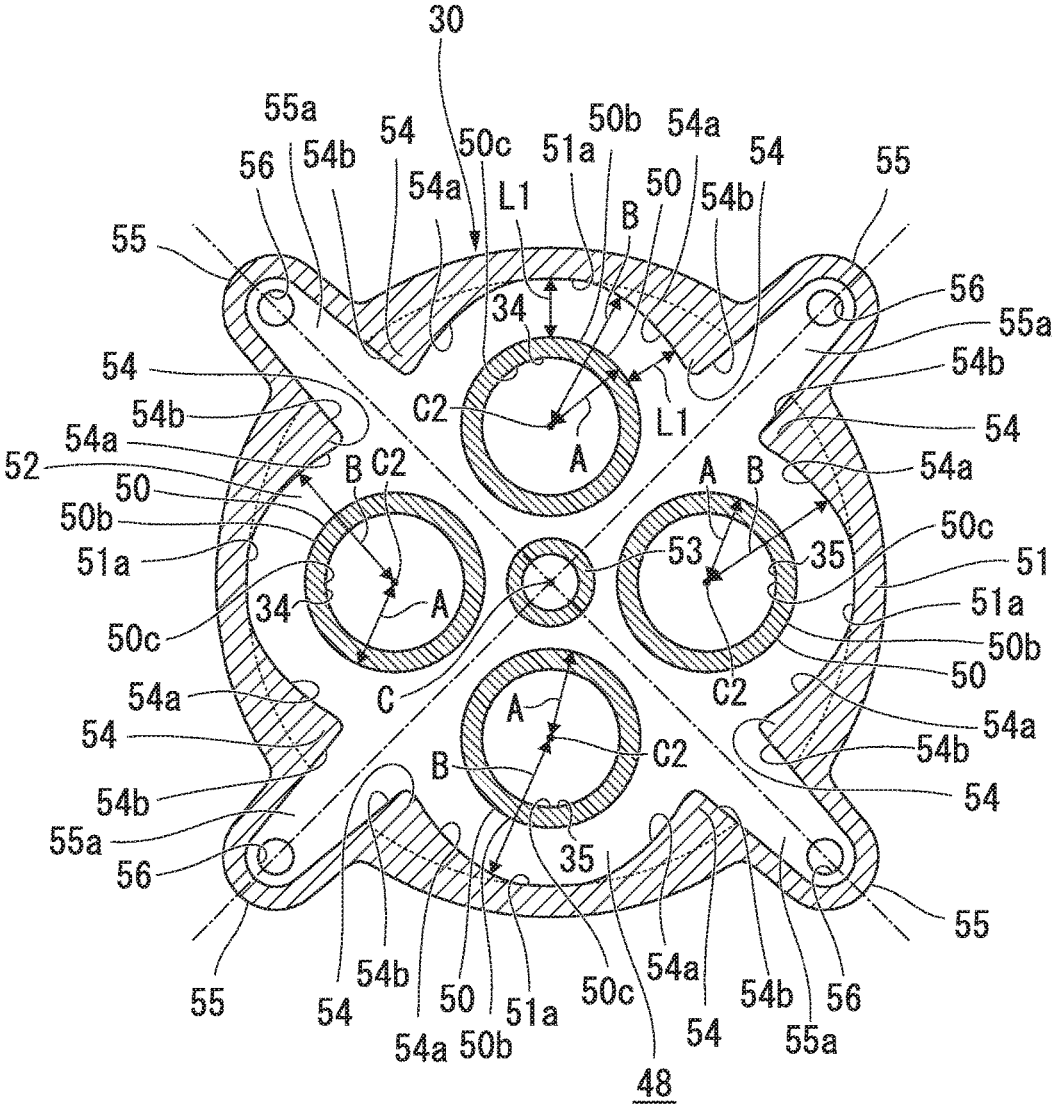
FIG. 2 is a cross-sectional view taken along line II-II of FIG. 1.

FIG. 2 is a cross-sectional view taken along line II-II of FIG. 1 in the embodiment of the present invention.

As shown in FIGS. 1 and 2, in the cylinder head 30, a water chamber 48 through which cooling water for cooling the roof surface 31 circulates is formed just above the roof surface 31. The water chamber 48 is defined by a head main body 49, a port wall portion 50, an outer circumferential wall portion 51 and a bottom wall portion 52.

The port wall portion 50 extends from a bottom surface 49*a* of the head main body 49 toward the roof surface 31. The port wall portions 50 are formed in circular tube shapes which form flow paths of the intake port 34 and the exhaust port 35. The port wall portions 50 are arranged at intervals in a circumferential direction centering on the central axis C. In other words, a center of the port wall portion 50 is disposed on the same circle centering on the central axis C. A seat portion 50*a* is formed on an end edge of the port wall portion 50 on the side close to the roof surface 31. The seat portion 50*a* can close the intake flow path and the exhaust flow path by coming in contact with the intake valve 36 and the exhaust valve 37.

The outer circumferential wall portion 51 is formed so that a cross-sectional contour thereof has a circular cylindrical shape centering on the central axis C, i.e., an annular shape. The outer circumferential wall portion 51 extends from an outer circumferential edge of the bottom surface 49*a* toward the roof surface 31. The water chamber 48 is disposed at a radially inner side of the outer circumferential wall portion 51, that is, between the port wall portion 50 and the outer circumferential wall portion 51.

The outer circumferential wall portion 51 has a padding portion 54 in part along a circumferential direction thereof. This padding portion 54 protrudes to the radially inner side of the outer circumferential wall portion 51. Due to the padding portion 54, a distance L1 between an inner circumferential surface 51*a* of the outer circumferential wall portion 51 and an outer circumferential surface 50*b* of the port wall portion 50 opposite to the inner circumferential surface 51*a* is equal to or shorter than a predetermined distance. Here, the distance L1 is determined according to the tensile stress acting on the bottom wall portion 52 due to an internal pressure of the main combustion chamber 33 and thermal energy. The tensile stress acting on the bottom wall portion 52 is increased as the distance L1 is increased.

In the outer circumferential wall portion 51 of the embodiment, cooling water inlet/outlet portions 55 which protrude radially outward are formed at a plurality of positions in the circumferential direction. A hole 56 for allowing the cooling water to flow in and out is formed in each of the cooling water inlet/outlet portions 55. Each of the holes 56 communicates with the water chamber 48. Four holes 56 are formed in the embodiment, and two holes 56 are arranged on each diagonal line (indicated by a one-dot chain line in FIG. 2) passing through the central axis C. In one example of the embodiment, the port wall portion 50 is not disposed on the diagonal line passing through the hole 56. Further, a flow path 55*a* in which a circumferential width is increased as it approaches the central axis C in a radial direction is formed in the cooling water inlet/outlet portion 55.

The above-described padding portion 54 is formed so that a thickness thereof on the side close to the cooling water inlet/outlet portion 55 in the circumferential direction centering on the central axis C is the largest and the thickness thereof is gradually reduced outward from the cooling water inlet/outlet portion 55 in the circumferential direction. Here, in FIG. 2, an inner circumferential surface of the outer circumferential wall portion 51 in the absence of the padding portion 54 is indicated by a broken line.

A surface 54*a* of the padding portion 54 facing the port wall portion 50 is a concave curved surface passing through a concentric circle of the port wall portion 50. Further, the surface 54*b* of the padding portion 54 facing the cooling water inlet/outlet portion 55 side (in other words, the diagonal line side) in the circumferential direction centering on the center axis C is slantly formed to be gradually away from the diagonal line toward the central axis C, thereby extending an inner wall surface forming the flow path 55*a* of the cooling water inlet/outlet portion 55.

The padding portion 54 is formed so that the distance between the inner circumferential surface 51*a* of the outer circumferential wall portion 51 and the port wall portion 50 is equal to or less than the predetermined distance as described above. The padding portion 54 is formed so that a thickness at a portion thereof facing the port wall portion 50 satisfies a relationship of $B/A \leq 1.8$ when a distance from a port center C2 of the port wall portion 50 to the outer circumferential surface 50*b* of the port wall portion 50 is defined as "A" and a distance from the port center C2 to the inner circumferential surface 51*a* (or the surface 54*a*) of the outer circumferential wall portion 51 opposite to the port wall portion 50 is "B."

The padding portion 54 may be formed on part of the outer circumferential wall portion 51 close to the bottom wall portion 52 in a direction in which the central axis C extends. As a result, while a length of the bottom wall portion 52 in a direction from the port wall portion 50 to the outer circumferential wall portion 51 is shortened and the tensile stress is suppressed, a weight can be reduced as compared with the case in which the padding portion 54 is formed over an entire region of the outer circumferential wall portion 51 in a lengthwise direction (in other words, the direction in which the central axis C extends).

The bottom wall portion 52 connects an end of the outer circumferential wall portion 51 on the side close to the main combustion chamber with an end of the port wall portion 50 on the side close to the main combustion chamber. A surface of the bottom wall portion 52 facing the main combustion chamber 33 forms part of the above-described roof surface 31. In the bottom wall portion 52, the base holding wall portion 53 is formed around the central axis C. The base holding wall portion 53 is formed in a circular tube shape and forms the above-described base holding portion 47.

According to the above-described first embodiment, the inner circumferential surface 51*a* of the outer circumferential wall portion 51 can approach the outer circumferential surface 50*b* of the port wall portion 50 due to the padding portion 54. Therefore, the length of the bottom wall portion 52 in the direction from the port wall portion 50 to the outer circumferential wall portion 51 can be shortened. This makes it possible to increase the rigidity of the bottom wall portion 52 and thus makes it hard to bend. As a result, the tensile stress acting on the bottom wall portion 52 according to an increase in the in-cylinder pressure can be suppressed, and thus occurrence of breakage can be reduced.

Further, the relationship between the distance A from the port center C2 of the port wall portion 50 to the outer circumferential surface 50*b* of the port wall portion 50 and the distance B from the port center C2 to the inner circumferential surface 51*a* of the outer circumferential wall portion 51 facing the port wall portion 50 was made to satisfy B/A≤1.8. Accordingly, it is possible to suppress an increase in weight due to an excessive increase in the thickness of the padding portion 54 and thus to efficiently suppress the tensile stress acting on the bottom wall portion 52.

Further, the in-cylinder pressure of the gas engine 10 can be sufficiently increased, and thus high efficiency can be achieved. Therefore, a high output can be obtained without increasing a size of the gas engine 10. When it is not necessary to increase the output, the size of the gas engine 10 can be reduced.

Next, a cylinder head and an engine according to a second embodiment of the present invention will be described with reference to the drawings. The second embodiment is different from the above-described first embodiment only in the configuration of the port wall portion. Therefore, in the second embodiment, the same parts as those of the first embodiment are designated by the same reference numerals, and repeated description will be omitted.

Figure 3:
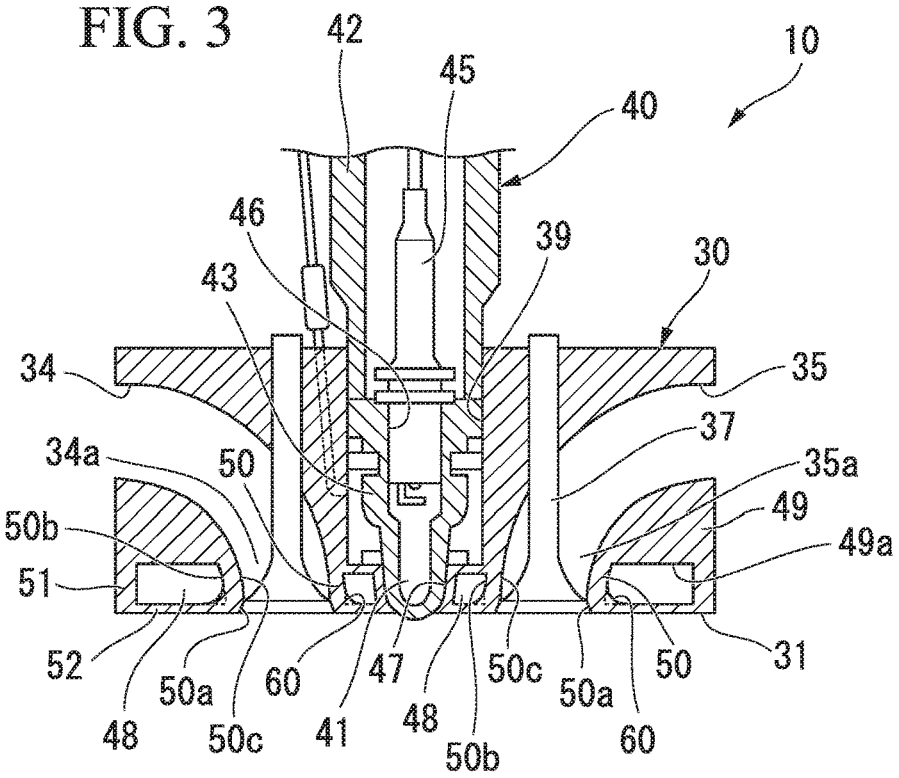
FIG. 3 is a cross-sectional view corresponding to FIG. 1 in a second embodiment of the present invention.

FIG. 3 is a cross-sectional view corresponding to FIG. 1 in a second embodiment of the present invention.

As shown in FIG. 3, a gas engine 10 includes at least a cylinder block 20 (not shown), a cylinder head 30 and an auxiliary chamber member 40.

An intake port 34 and an exhaust port 35 are formed in the cylinder head 30. In the cylinder head 30, a water chamber 48 which circulates cooling water for cooling a roof surface 31 is formed just above the roof surface 31. As in the first embodiment, the water chamber 48 is defined by a head main body 49, a port wall portion 50, an outer circumferential wall portion 51 and a bottom wall portion 52.

The port wall portion 50 has a port side padding portion 60 of which a thickness is gradually increased on an outer circumferential side thereof toward the side close to the bottom wall portion 52.

The port side padding portion 60 is formed with a concave curved surface and is formed to satisfy a relationship of R≥0.6×(B−A) when a curvature radius of the curved surface is defined as "R," a distance from a port center C2 (refer to FIG. 2) of the port wall portion 50 to an outer surface of the port wall portion 50 is "A" and a distance from the port center C2 to an inner circumferential surface 51*a* of the outer circumferential wall portion 51 is "B." Here, the distance A and the distance B do not include a thickness of the port side padding portion 60.

As in the first embodiment, a padding portion 54 (refer to FIG. 2) is formed in the outer circumferential wall portion 51.

Figure 4:
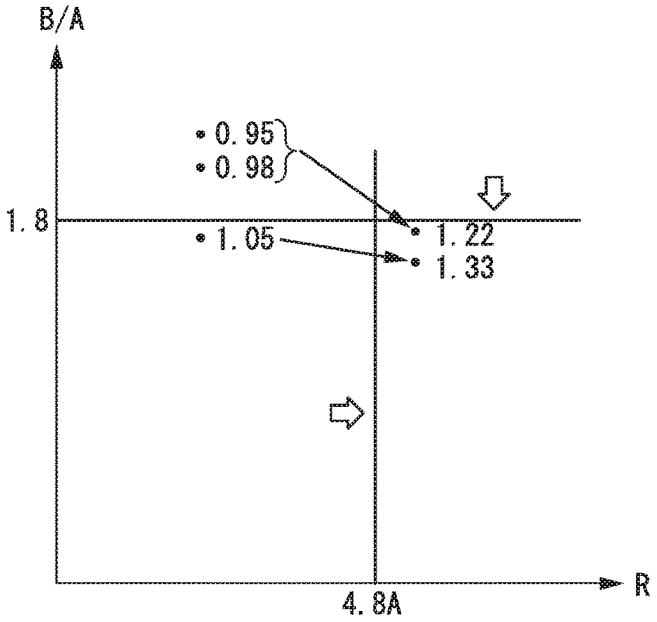
FIG. 4 is a graph showing a safety factor, in which a vertical axis is B/A and a horizontal axis is R.

FIG. 4 is a graph showing a safety factor, in which a vertical axis is B/A and a horizontal axis is R.

A reference value of a safety factor necessary for the bottom wall portion 52 of the cylinder head 30 is about 1.2. That is, it is necessary to increase the value of the safety factor to more than about 1.2.

As shown in FIG. 4, when the padding portion 54 and the port side padding portion 60 are not formed, the value of the safety factor at each position is "0.95," "0.98" and "1.05."

As described above, when the padding portion is formed to satisfy B/A≤1.8 and R≥0.6×(B−A), the value of the safety factor is "1.22" and "1.33" which is a sufficient safety factor larger than the reference value of the safety factor. That is, the curvature radius R of the curved surface of the port side padding portion 60 may be formed to be 4.8 A or more.

According to the above-described second embodiment, since the port wall portion 50 has the port side padding portion 60 of which the thickness is gradually increased on the outer circumferential side toward the side close to the bottom wall portion 52, the rigidity of the bottom wall portion 52 around the port wall portion 50 on which the tensile stress is easily concentrated can be improved.

Further, by satisfying the relationship of R≥0.6×(B−A), it is possible to efficiently suppress the tensile stress acting on the bottom wall portion 52 on the side closer to the port wall portion 50 while preventing the thickness of the port side padding portion 60 from being excessive and thus preventing the increase in the weight.

Next, a cylinder head and an engine according to a third embodiment of the present invention will be described with reference to the drawings. The cylinder head and the engine in the third embodiment are different from the above-described first and second embodiments only in the configuration of the exhaust port 35. Therefore, the same parts as those of the first and second embodiments are designated by the same reference numerals, and repeated description will be omitted.

Figure 5:
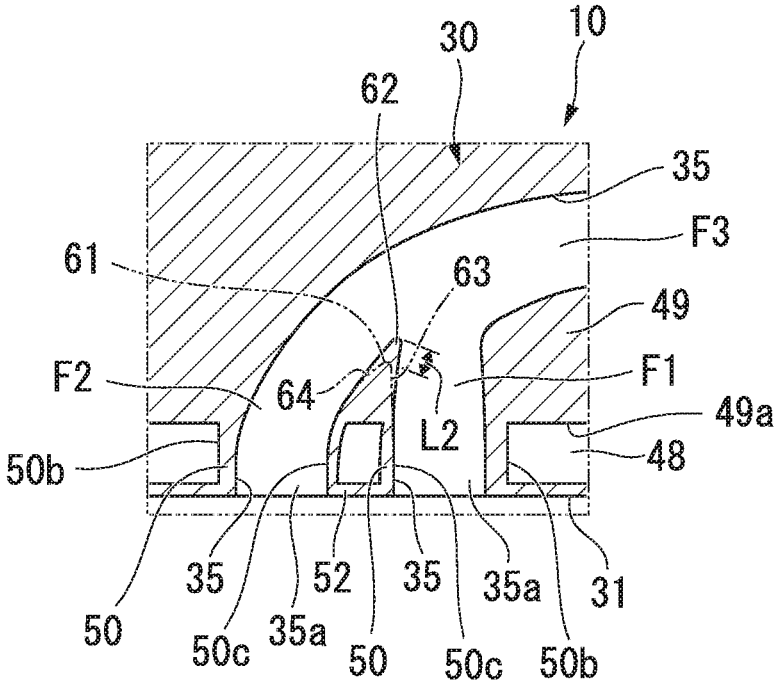
FIG. 5 is a cross-sectional view of an exhaust port in a third embodiment of the present invention.

FIG. 5 is a cross-sectional view of an exhaust port in a third embodiment of the present invention. In FIG. 5, the exhaust valve 37 is omitted for convenience of illustration.

As shown in FIG. 5, in the cylinder head 30 in the embodiment, a water chamber 48 is formed just above the roof surface 31 as in the above-described embodiments. The water chamber 48 is defined by a head main body 49, a port wall portion 50, an outer circumferential wall portion 51 and a bottom wall portion 52.

The port wall portion 50 extends from a bottom surface 49*a* of a head main body 49 toward a roof surface 31 as in each of the above-described embodiments. Each of the port wall portions 50 is formed in a circular tube shape which forms flow paths of an intake port 34 and an exhaust port 35.

More specifically, two port wall portions 50 of the exhaust port 35 are provided. The flow paths F1 and F2 formed by the port wall portions 50 rise upward from an end portion 35*a* on the side close to the cylinder 21 and are then joined and connected in the head main body 49. The flow paths F1 and F2 are joined and connected, and thus form a flow path F3 formed by one exhaust port 35 and extend toward the side of the head main body 49.

A rib 62 is formed at a crossing portion 61 at which the flow paths F1 and F2 intersect. The crossing portion 61 is a portion in which a surface 63 extending from an inner circumferential surface 50*c* of the port wall portion 50 and a surface 64 (both indicated by two-dot chain lines in FIG. 5) intersect. The rib 62 extends toward a downstream side of the flow path F3 along the flow path F3 in a direction away from the bottom wall portion 52. A length L2 of the rib 62 is formed to satisfy the above-mentioned reference value of the safety factor. For example, when it is desired to increase the safety factor, the length L2 of the rib 62 may be made longer.

According to the above-described third embodiment, even when a plurality of port wall portions 50 are joined and connected to each other and have a disadvantageous structure in terms of rigidity, the rigidity of the port wall portion 50 can be improved in the joined and connected portion by the provided rib 62. Since the rib is provided in the flow path of the exhaust port 35, a rectification effect can also be obtained.

Even when the plurality of flow paths F1 and F2 are joined and connected and have a disadvantageous structure in terms of the rigidity of the bottom wall portion 52 against the in-cylinder pressure of the cylinder 21, the rigidity of the bottom wall portion 52 against the in-cylinder pressure of the cylinder 21 can be improved by the provided rib 62.

The present invention is not limited to the above-described embodiments and includes various modifications to the forms of the above-described embodiments within the scope not deviating from the gist of the present invention. That is, the specific shapes and configurations described in each of the above-described embodiments are merely examples and can be appropriately changed.

For example, in each of the above-described embodiments, the case in which the four holes 56 are formed and the two holes 56 are disposed on each diagonal line passing through the central axis C has been described. However, the arrangement of the holes 56 is not limited to the above-described configuration. For example, three or fewer holes 56 may be provided, or five or more holes 56 may be provided. Further, the arrangement of the holes 56 is not limited to the diagonal lines passing through the central axis C.

Furthermore, in the above-described third embodiment, the case in which the rib 62 is formed in the middle of the flow path of the exhaust port 35 has been described. However, it is not limited to the exhaust port 35. For example, when the flow path of the intake port 34 is branched and connected, a rib similar to the rib 62 may be formed at the crossing portion between the flow paths of the intake ports 34.

In each of the above-described embodiments, the case in which two port wall portions 50 for the intake port 34 and the two port wall portions 50 for the exhaust port 35 are provided has been described. However, the number of the port wall portions 50 is not limited to the above-described number. Furthermore, in each of the above-described embodiments, the case in which the centers of the plurality of port wall portions 50 are arranged on the same circle centering on the central axis C has been described. However, the arrangement of the port wall portions 50 is not limited to the above-described arrangement. That is, the centers of the plurality of port wall portions 50 may not be arranged on the same circle centering on the central axis C.

Further, in each of the above-described embodiments, the case in which the gas engine 10 is used as the engine has been described as an example, but the present invention is not limited to the gas engine. As long as the engine has the water chamber 48 on the side close to the roof surface 31, any engine can be used. For example, the present invention can be applied to a diesel engine, a gasoline engine or the like.

INDUSTRIAL APPLICABILITY

According to the cylinder head and the engine of the present invention, it is possible to suppress occurrence of breakage by suppressing the tensile stress acting on the bottom wall portion according to the increase in the in-cylinder pressure.

REFERENCE SIGNS LIST

10 Gas engine
20 Cylinder block
20*a* End surface
21 Cylinder
22 Piston
23 Connecting rod
24 Crankshaft
25 Pin
26 Pin
30 Cylinder head
31 Roof surface
33 Main combustion chamber
34 Intake port
34*a* End
35 Exhaust port
35*a* End
36 Intake valve
37 Exhaust valve
39 Auxiliary chamber member holding hole
40 Auxiliary chamber member
42 Auxiliary chamber holder
43 Auxiliary chamber base
45 Ignition plug
46 Plug holding hole
47 Base holding portion
48 Water chamber
49 Head main body
50 Port wall portion
50*a* Seat portion
50*b* Outer circumferential surface
50*c Inner circumferential surface*
51 Outer circumferential wall portion
51*a* Inner circumferential surface (inner surface)
52 Bottom wall portion
53 Base holding wall portion
54 Padding portion
54*a* Surface
54*b Surface*
55 Cooling water inlet/outlet portion
55*a* Flow path
56 Hole
60 Port side padding portion
61 Crossing portion
62 Rib
63 Surface
64 Surface
C Central axis
C2 Port center
F Flow path
L1 Distance
L2 Length

The invention claimed is:

1. A cylinder head comprising:

a plurality of port wall portions configured to form flow paths for intake and exhaust;

an outer circumferential wall portion formed in an annular shape disposed at an interval on an outside of the plurality of port wall portions and having a water chamber through which cooling water flows and which is formed at least between the port wall portions and the outer circumferential wall portion; and a bottom wall portion configured to face a combustion chamber of an engine and to connect ends of the port wall portions and the outer circumferential wall portion, wherein the outer circumferential wall portion includes a padding portion of which a thickness is increased toward a side close to the port wall portions so that a distance between the port wall portions and the outer circumferential wall portion is equal to or less than a predetermined distance and of which a surface facing one of the port wall portions is a concave curved surface passing through a concentric circle of the one of the port wall portions in the cross-sectional view.

2. The cylinder head according to claim 1, wherein the padding portion is formed on part of the outer circumferential wall portion on a side close to the bottom wall portion.

3. The cylinder head according to claim 1, wherein the padding portion is formed so that a thickness at a portion thereof facing the port wall portion satisfies a relationship of $B/A \leq 1.8$ when a distance from a port center of the port wall portion to an outer surface of the port wall portion is defined as "A" and a distance from the port center to an inner surface of the outer circumferential wall portion opposite to the port wall portion is "B."

4. The cylinder head according to claim 1, wherein at least one of the plurality of port wall portion has a port side padding portion of which a thickness is gradually increased on an outer circumferential side thereof toward a side close to the bottom wall portion.

5. The cylinder head according to claim 4, wherein the port side padding portion is formed with a concave curved surface and satisfies a relationship of $R \geq 0.6 \times (B-A)$ when a curvature radius of the curved surface is defined as "R," a distance from a port center of the port wall portion to an outer surface of the port wall portion is "A" and a distance from the port center to an inner surface of the outer circumferential wall portion is "B."

6. The cylinder head according to claim 1, wherein flow paths formed by at least part of the plurality of port wall portions rise upward from the bottom wall portion, are then joined and connected together and have a rib which extends along the flow paths from a crossing portion at which the flow paths intersect in a direction away from the bottom wall portion.

7. An engine comprising;

the cylinder head according to claim 1; and a cylinder block to which the cylinder head is fastened.

* * * * *